United States Patent [19]

Sacco

[11] Patent Number: 4,828,889

[45] Date of Patent: May 9, 1989

[54] GOOD LUCK CHARM

[76] Inventor: Edward Sacco, 258 Storm Dr., Holtsville, N.Y. 11742

[21] Appl. No.: 152,163

[22] Filed: Feb. 4, 1988

[51] Int. Cl.[4] ..... A44C 23/00

[52] U.S. Cl. ..... 428/3; 63/2; 63/13; 446/392

[58] Field of Search ..... 63/2, 12, 13, 21, 23, 63/15, DIG. 3; D11/79, 43, 75; 446/392, 343; 428/3, 28

[56] References Cited

U.S. PATENT DOCUMENTS

| | | | |
|---|---|---|---|
| D. 159,495 | 8/1950 | Linden | 428/3 X |
| 659,802 | 10/1900 | Rohlfs | 428/3 X |
| 689,669 | 12/1901 | Derus | 446/392 X |
| 1,713,285 | 5/1929 | Juergens | 63/13 X |
| 2,477,460 | 7/1949 | Larson | 446/392 |
| 2,579,725 | 12/1951 | Burnbaum | 428/3 X |
| 3,081,997 | 3/1963 | Glass et al. | 63/15 X |
| 3,443,398 | 5/1969 | King, Jr. | 63/13 |
| 4,196,899 | 4/1980 | Patterson | 428/3 X |

FOREIGN PATENT DOCUMENTS

| | | | |
|---|---|---|---|
| 1472522 | 5/1977 | United Kingdom | 446/392 |

OTHER PUBLICATIONS

"National Jeweler", Magazine; Feb. 1978; Matchmates—Omi Earrings.

*Primary Examiner*—Kenneth J. Dorner
*Assistant Examiner*—Laurie K. Cranmer
*Attorney, Agent, or Firm*—Richard L. Miller

[57] ABSTRACT

A good luck charm is designed to be attractive and functional. Primarily, it consists of a simulated parabolic dish secured to the top of a conical base, and an eye with an elongated iris is mounted by a stem to the inside of the dish by a screw that enables the iris to be positoined horizontally, vertically or at a arbitrary angular position.

2 Claims, 1 Drawing Sheet

GOOD LUCK CHARM

BACKGROUND OF THE INVENTION

The instant invention relates generally to charms, and more particularly, to a good luck charm-modern transylvanian talisman.

Numerous devices have been provided in the prior art that are adapted to provide good luck for the owner thereof. For example, U.S. Pats. Nos. 4,196,899 of Patterson, 2,579,725 of Burnbaum, and 659,802 of Rohlfs, all are illustrative of such prior art. While these units may be suitable for the particular purpose to which they address, they would not be as suitable for the purpose of the present invention as hereafter described.

SUMMARY OF THE INVENTION

A primary object of the present invention is to provide a good luck charm/Modern Transylvanian Talisman that will overcome the shortcomings of the prior art devices.

Another object is to provide a good luck charm/-Modern Transylvanian Talisman that will be a benevolent protector of the folklore of old Transylvanian simulating the state of the art and wizardry of modern electromagnetic technology.

Technology:

The microwave dish mounted on a pedestal as depicted or fixed to a tower or by itself, serves as a vessel to simulate capture or the transmission of electromagnetic radiation. (This is the normal application in microwave radio or telemetry).

The brain is capable of producing electrical waves which is the basis for the operation of the electroencephalogram. In a similar fashion there is belief that the brain (and it follows the body), can be controlled or effected by external electromagnetic forces.

Another object is to provide a good luck charm/-Modern Transylvanian Talisman that will contain the benevolent eye in a microwave dish so as to simulate capture of any evil electromagnetic forces directed towards one or in a person's area, and reflect them harmlessly out into space. Among other things, the present invention serves as a protective charm.

An additional object is to provide a good luck charm/Modern Transylvanian Talisman that will be unique and also attractive in appearance.

A further object is to provide a good luck charm/-Modern Transylvanian Talisman that is simple and easy to use.

A still further object is to provide a good luck charm/Modern Transylvanian Talisman that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
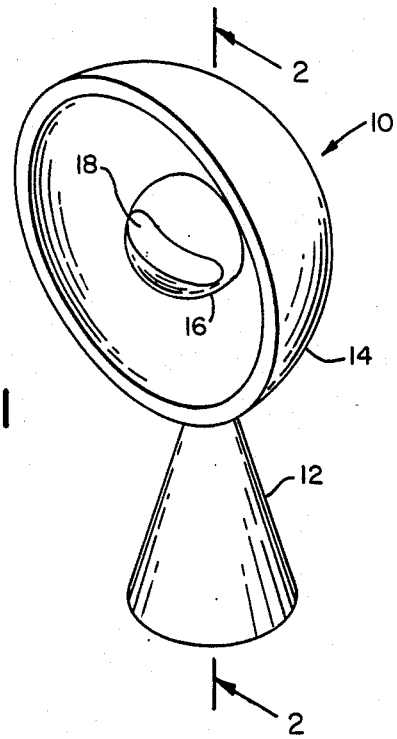
FIG. 1 is a perspective view of the instant invention.
Figure 2:
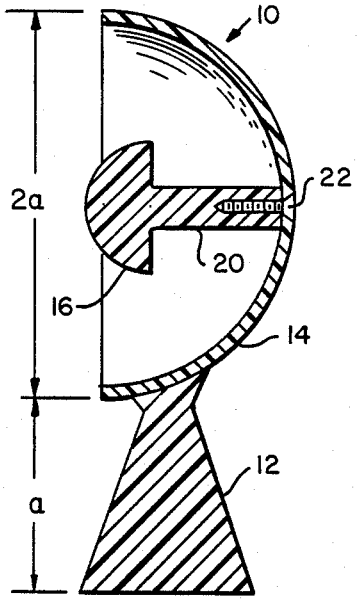
FIG. 2 is a cross sectional view taken on line 2—2 of FIG. 1.
Figure 3:
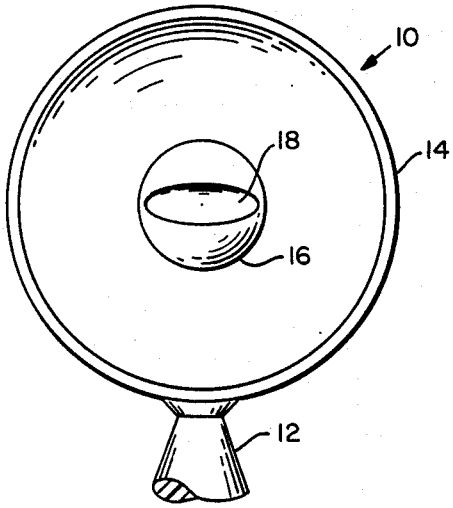
FIG. 3 is a fragmentary front elevational view of the invention.

Turning now descriptively to the drawings, in which like reference characters denote like elements throughout the several views, a charm device 10 is shown to include a conical base 12 having fixedly secured thereto, a substantially parabolic dish 14, and it shall be noted that in the application as presented in FIGS. 1 through 3, the diametrical dimension *2a* should preferably be twice that of the base 12 height dimension a, although such is not of importance insofar as jewelry is concerned.

A semi-spherical eye member 16 is centrally disposed in the front of the dish 14 and is provided with an iris 18 of elongated oval configuration, and a stem 20 is integrally attached to the rear of eye 16. A screw fastener 22 is received through a rear portion of dish 14 and an end of stem 20, and serves to fasten eye 16 in dish 14. The fastener 22 also enables the iris 16 to be positioned either horizontally, vertically, or at an arbitrary angular position in the dish 14.

In use, device 10 is mounted anywhere desired, such as, on desks or the like to serve as a paper weight or other decorative article.

Further, device 10 may be made of any desired material.

Figure 4:
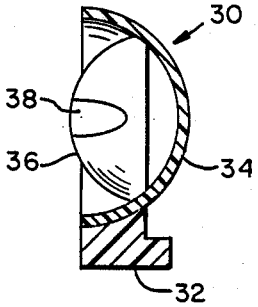
FIG. 4 is a cross sectional view similar to FIG. 2 of a modified form of the invention.

Referring now to FIG. 4, a modified form of device 30 is shown to include a short base 32 that is fixedly secured to the outer periphery of a dish 34, and an eye 36 is fixedly secured at its rear portion to the inner periphery of the dish 34. Eye 36 is also provided with an iris 38.

In use, modified form of device 30 is employed in the same manner as was described of device 10, the only exception being, that the eye 38 is not stem or post mounted and the base 32 is shorter.

Figure 5:
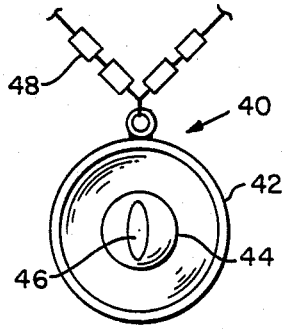
FIG. 5 is a fragmentary front elevational view of another modified form shown as a necklace.

Looking now at FIG. 5, a second modified form of device 40 is in the form of jewelry and includes a dish 42 having an eye 44 secured therein in a manner (not shown), and eye 44 also typically may include an elongated iris 46.

Figure 6:
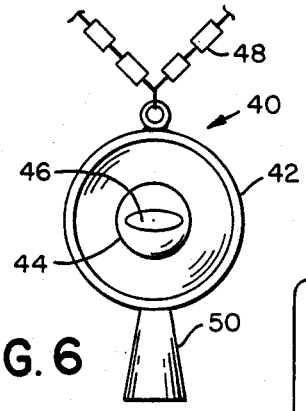
FIG. 6 is similar to FIG. 5, but illustrated with the pedestal.

Looking now at FIG. 6, the structure is the same as FIG. 5, except that a base 50 has been added thereto.

Figure 7:
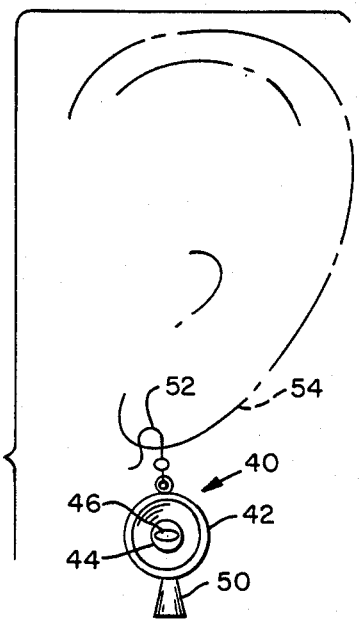
FIG. 7 is a diagrammatic modified form shown as an earing.

Looking now at FIG. 7, the device 40 no longer is provided with a chain, but has a hook 52 secured to the dish 42, for mounting to an ear lobe 54.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A good luck charm, comprising a conical base having an upper end, a parabolic shaped open dish secured to the upper end of said base such that the opening is perpendicular to a central axis of the conical base, and an eye member secured in said open dish, wherein said conical base is fixedly secured to an outer periphery of said open dish, and said eye member includes a stem fixedly secured to an inner rear surface of the dish and a fastener is received through said dish and an end of the stem, and fixedly secures said eye member in a center of an inner periphery of said dish.

2. A good luck charm as set forth in claim 1, wherein a face of said eye member includes an elongated iris and said iris is positioned horizontally and vertically by means of a screw which is tightened after rotation of said eye to a desired position.

* * * * *